US007311105B2

(12) United States Patent
Plummer, Jr. et al.

(10) Patent No.: US 7,311,105 B2
(45) Date of Patent: Dec. 25, 2007

(54) MASK HAVING A SCENTING MEANS, AND METHOD FOR BLOCKING OUT UNPLEASANT ODORS

(76) Inventors: Willie Pressly Plummer, Jr., 10128 Faywood St., Bellflower, CA (US) 90706; Kevin George Vereene, P.O. Box 4448, Alexandria, VA (US) 22303

( * ) Notice: Subject to any disclaimer, the term of this patent is extended or adjusted under 35 U.S.C. 154(b) by 60 days.

(21) Appl. No.: 10/971,035

(22) Filed: Oct. 25, 2004

(65) Prior Publication Data

US 2006/0107959 A1 May 25, 2006

Related U.S. Application Data

(60) Provisional application No. 60/514,981, filed on Oct. 29, 2003.

(51) Int. Cl.
*A62B 18/02* (2006.01)

(52) U.S. Cl. ..... 128/206.19; 128/205.25

(58) Field of Classification Search ..... 128/205.25, 128/205.27, 205.29, 206.12, 206.18, 206.19, 128/206.21, 206.26, 206.28, 207.13; 2/9, 2/206, 424, 901

See application file for complete search history.

(56) References Cited

U.S. PATENT DOCUMENTS 1,541,299 A * 6/1925 Walters ..... 206/219
2,395,109 A * 2/1946 Fonda ..... 128/203.21
2,546,848 A * 3/1951 Rogers ..... 128/203.21
2,681,168 A * 6/1954 McMillion ..... 222/94
3,856,142 A * 12/1974 Vessalo ..... 206/530
3,881,634 A * 5/1975 Thrun ..... 222/3
4,283,011 A * 8/1981 Spector ..... 239/36
4,342,395 A * 8/1982 Brown ..... 206/530
D269,374 S * 6/1983 Brown ..... D24/34
4,503,851 A * 3/1985 Braunroth ..... 128/203.29
4,790,307 A * 12/1988 Haber et al. ..... 128/206.19
5,133,458 A * 7/1992 Miller ..... 206/530
5,243,708 A * 9/1993 Vanuch ..... 2/206
5,538,013 A * 7/1996 Brannon ..... 128/857
5,690,958 A * 11/1997 McGrath ..... 424/451
5,697,105 A * 12/1997 White ..... 2/206
6,039,488 A * 3/2000 Krawczyk et al. ..... 401/132
6,779,524 B2 * 8/2004 Strawder et al. ..... 128/206.21
7,004,167 B2 * 2/2006 Cheng ..... 128/206.19
2005/0081856 A1 * 4/2005 Cheng ..... 128/205.25

* cited by examiner

*Primary Examiner*—Teena Mitchell

(57) ABSTRACT

A mask placeable over at least one respiratory organ of a user's face for blocking out unpleasant odors and for emitting a scent which is pleasant to the user. The mask has an air-permeable body with an inner surface shaped to fit over a respiratory organ of the user, a strap for securing the mask on the user, and an air-permeable scenting device to emit different scents which are pleasant to the user. The air-permeable scenting device includes a substantially tubular body within a pocket attached to the inner surface of the air-permeable body. The tubular body is breakable by applying a bending moment to the tubular body. Upon breaking, the tubular body releases a scent. The scenting device further includes a membrane substantially enclosing the tubular body. The membrane is substantially saturable by the scent when the tubular body is broken to release the scent through said air-permeable body.

13 Claims, 3 Drawing Sheets

MASK HAVING A SCENTING MEANS, AND METHOD FOR BLOCKING OUT UNPLEASANT ODORS

This application claims benefit of priority of Provisional Application Ser. No. 60/514,981, filed Oct. 29, 2003.

BACKGROUND OF THE INVENTION

1. Field of the Invention

This invention relates generally to face mask devices, and more particularly to a mask device having a scenting means for the purpose of blocking out unpleasant odors. The scented mask can be used in a number of areas in which a means for blocking out of unpleasant odors such as for hospital use, nursing homes, fire fighting usage, and mortuary and funeral home usage and many others areas.

2. Description of the Prior Art

Various kinds of mask devices and inhalation apparatuses are known in the art, the most common of which being the hospital surgical mask used in the operating room to maintain a sterilized are and to prevent germs from being spread orally. Standard mask are not however suitable for blocking out unpleasant odors.

U.S. Pat. No. 5,538,013 discloses a mask placeable over at least one respiratory organ of a user for blocking out unpleasant odors includes an air-permeable body having an inner surface, an outer surface, and a strap for securing the mask in place over the user's face. An air permeable scenting portion is secured to the inner surface of the body and, upon inhalation by the user, scents the otherwise foul smelling air drawn into the mask enclosure. Preferably, a plurality of scenting portions are provided, with each scenting portion representing a different desired scent. According to the several embodiments taught by the invention, the scenting portions are interchangeable to adjust the degree and variety of scent introduced.

U.S. Pat. No. 5,243,708 discloses masks which are produced which disguise or counteract strong odors that would ordinarily make the environment unpleasant. Mask are treated with a fixate carrier and at least one odor-masking or counteracting agent in a volatile solvent. In a preferred embodiment, both the inner and outer mask surfaces are essentially a continuous, homogeneous layer.

SUMMARY OF THE PRESENT INVENTION

The invention, an improved mask having scenting means for blocking out unpleasant odors. The mask includes an air-permeable body shaped to fit over the nose and mouth of a user, and a strap extending from opposite sides of the mask, which secures the mask over the user's face. The scenting means include a scenting portion which includes plurality of differently scented portions which is secured with a pocket securing portion to the inner surface of the mask.

The advantage of the invention is to provide an improved mask, to provide means for blocking out unpleasant odors, after breakage of the scenting means, this helps to provide a mask that can be used in a plurality of areas that a mask apparatus would be needed in, and to provide a more user friendly mask with an infinite shelf life. Still further objects and advantages will become apparent from a study of the following description and the accompanying drawings.

BRIEF DESCRIPTION OF THE DRAWING

Reference will now be made to the attached drawing, when read in combination with the following specification, wherein like reference numerals refer to the parts throughout the several views, and in which.

DESCRIPTION OF THE PREFERRED EMBODIMENTS

Figure 1:
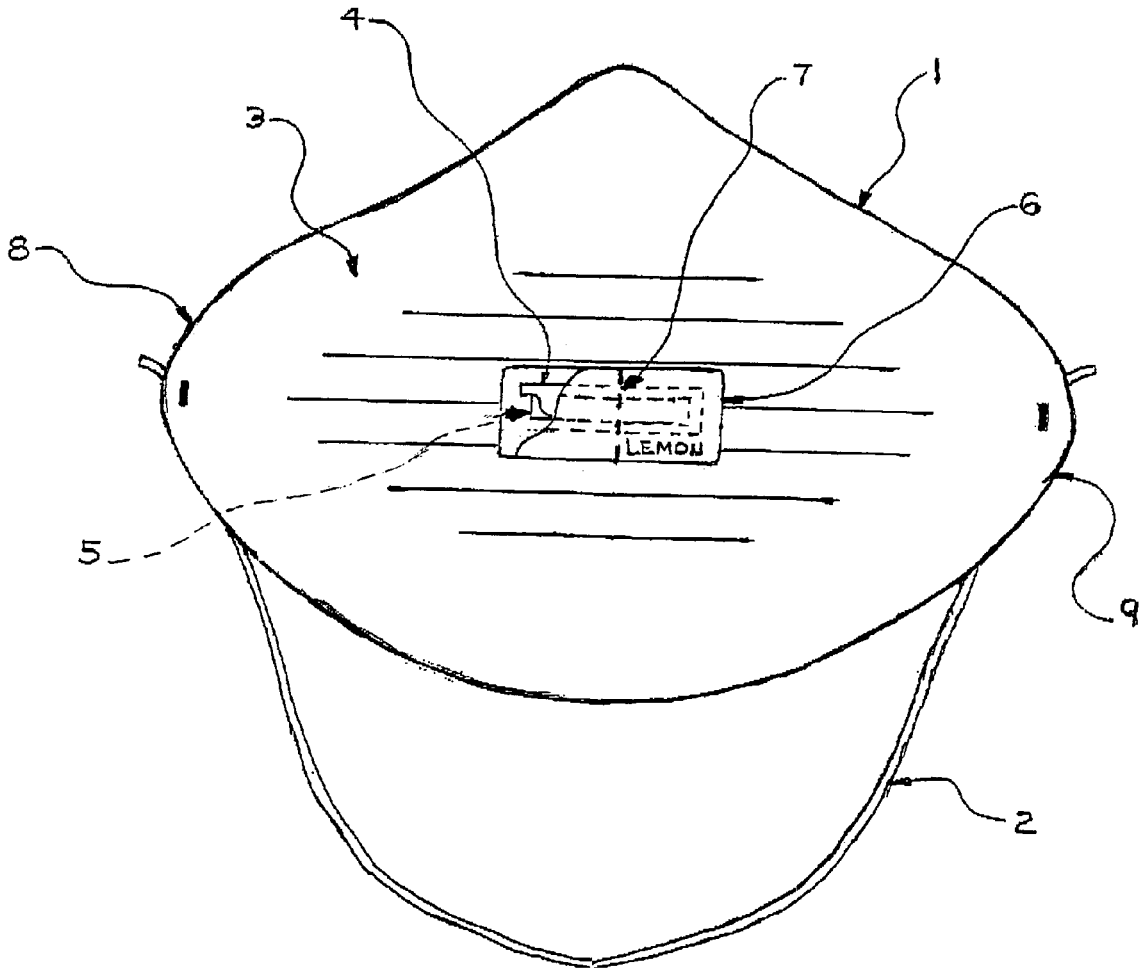
FIG. 1—is a rear or inside view of a mask having a scenting means according to the preferred embodiment of the present invention.
Figure 2:
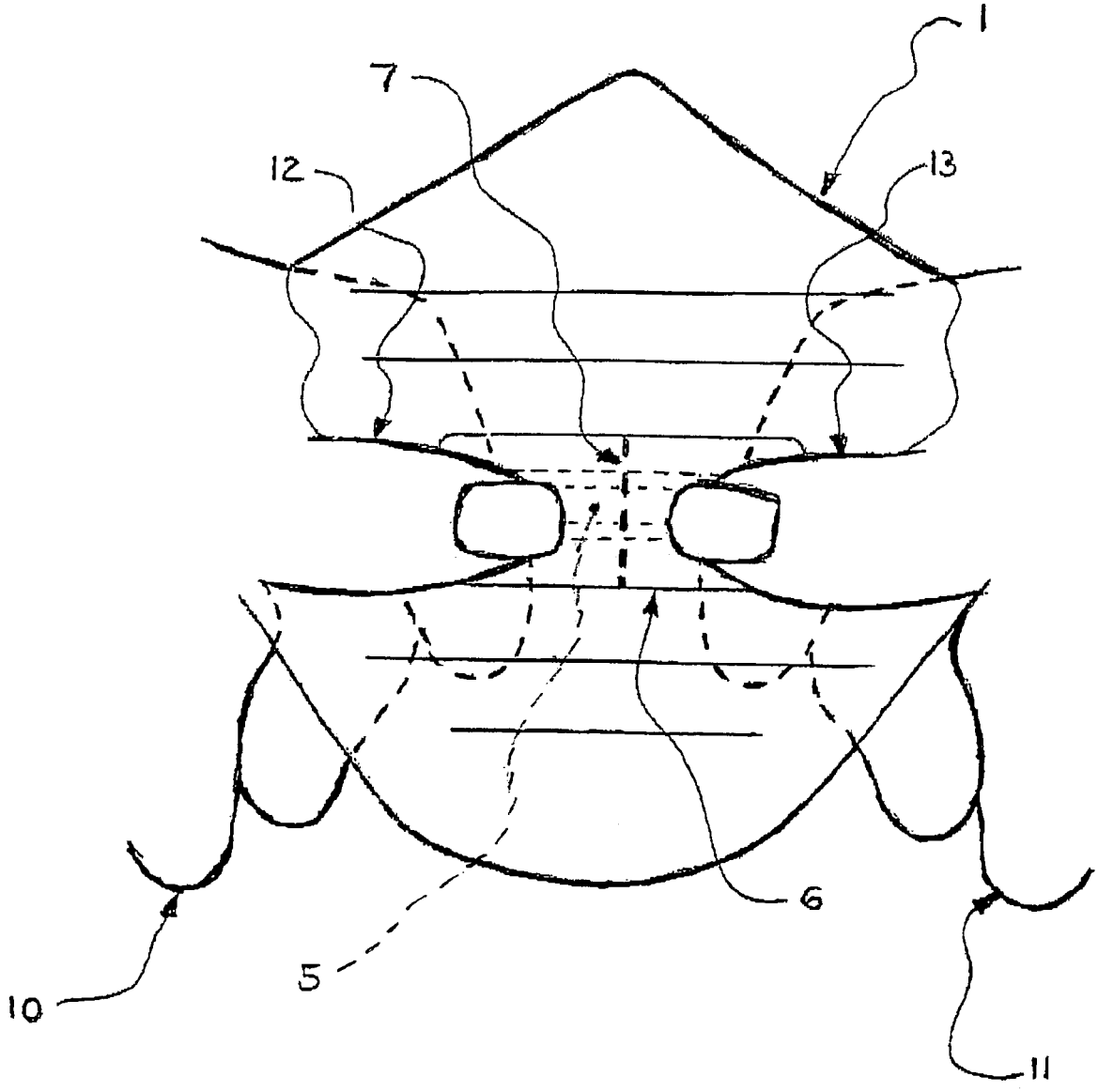
FIG. 2—is a rear view of a mask having a scenting means in the hands of the user.
Figure 3:
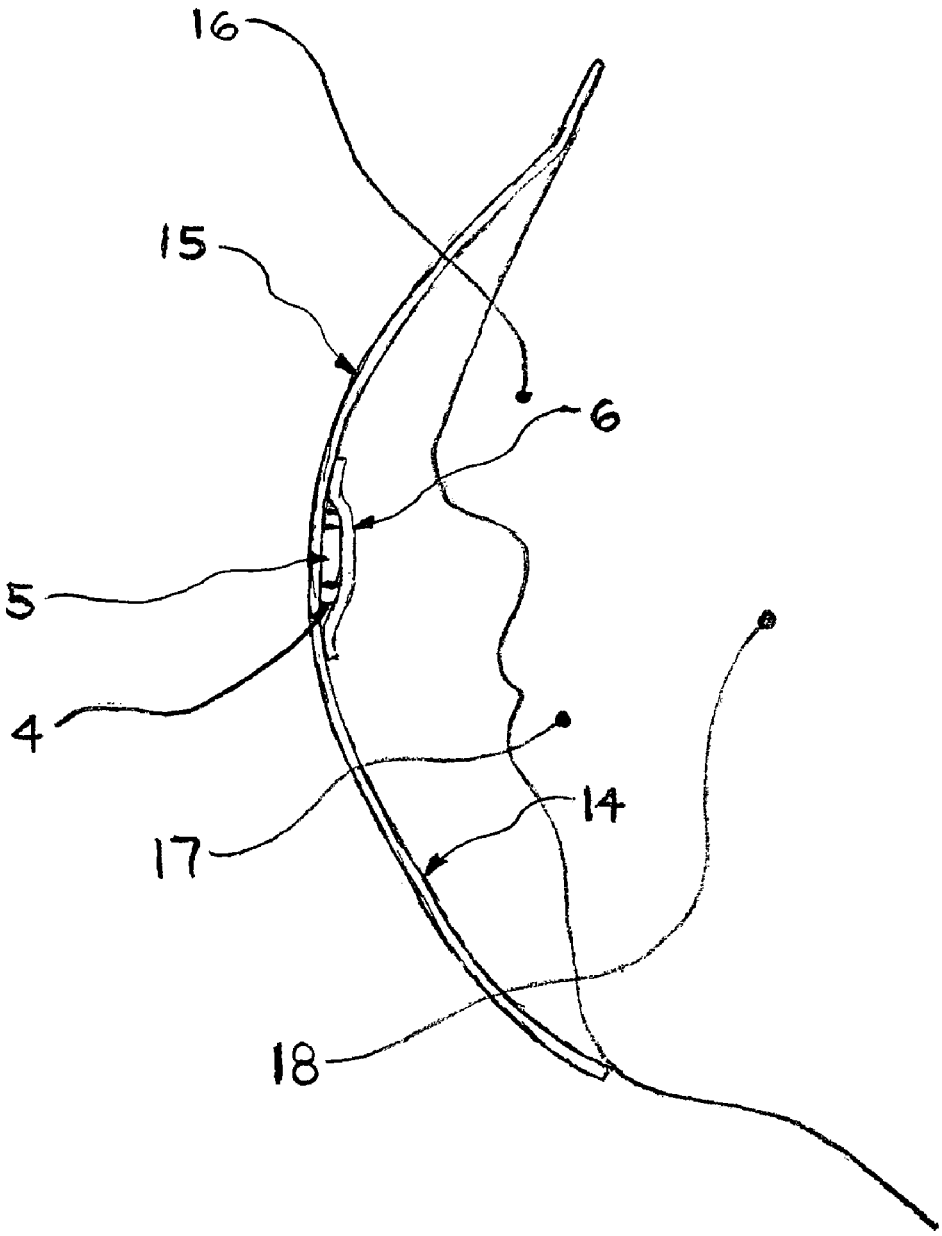
FIG. 3—is a side view of a mask having a scenting means on the face of the user.

Referring to FIGS. 1, 2 and 3 according to a first preferred embodiment of the present invention is shown. The mask 1 is constructed of an air-permeable body 3 such as a foam rubber shell or, alternatively, a porous plastic durable light weight shell and a heavy cotton or polyfiber cover stretched over the shell. The body 3 is bowl shaped and has an inner surface 14 and an outer surface 15 and a general outline which covers at least one respiratory organ of a user. The body 3 shown in FIG. 3 is a generally triangular outline to cove both the nose and mouth but it is also understood the mask can be shaped in any other desired manner, such as an oval or square, and still fulfill the requirements of the present invention.

Referring to FIGS. 2 and 3, the mask 1 is shown in place over a nose 16 and mouth 17 of the user's face 18. The mask 1 could also be shaped so as to cover only the nose 16 since a user's olfactory abilities are mostly limited to that respiratory organ. A strap 2 extends from opposite sides 8 and 9 of the mask is placed over the user's face, but could also be a two piece device having a hook and fastener or other conventional securing means (not shown).

Referring again to FIG. 1 and 3, a scenting means 4 is mounted to the inner surface 14 of the mask body in a substantially central location of the body. According to the first preferred embodiment, the mask's scenting means 4 is a rectangular shaped device which is secured in between both inner surface 14 of the mask 1 and the pocket securing portion 6 with an adhesive securing means (not shown). The scenting means 4 contains a scented portion 5 (ampoule) which has a conventional scent generating material for encouraging the generation of a desired scent within the enclosure of scented portion 5 which is a part of the mask body.

The scenting means which is a closed body member is capable of housing any one of a number of distinctive scents or inhalants (liquid or solid form) within the enclosure, such as grape, orange, cherry or watermelon, which act to block out unpleasant odors which exist on the outside of the mask which are associated with an unpleasant task to be performed. The scented portion can also include some form of indicia, such as pine decal is printed upon the pocket securing portion to indicate what type of scented portion is being utilized. Which only a single scented portion 5 is shown in the embodiment of FIGS. 1 and 3, is understood that a plurality of different scented portions can be provided to be within the scenting means 4 could be attached before hand according to the user's desire of chosen mask body.

The scented portion 5 is capsule shaped device, constructed of glass, plastic or any type of polyfiber material with a cloth like material jacket totally enclosing the scented portion which is the scenting means 4. Also, the material in which the scented portion is constructed of is a breakable or crushable. This advantage allows the scented portion after being broken or crushed to release the sent or the inhalant that was within for the purpose of blocking out unpleasant odors. The scented portion can also be configured to be a plurality of lengths and out side diameters for the purpose of holding different volumes of liquid or different sizes of the solid form of distinctive scents or inhalants which can be contained within the scented portion. With the scented portion being a closed body member, the scented portion can stored away for future use which will give the mask with a scented means an indefinite shelf life.

Referring to FIGS. 2 and 3, the mask 1 is shown within the hands of the user so that the inner surface 14 of the mask 1 can be seen. After the mask 1 is positioned between the fingers 10 and 11 and the thumbs 12 and 13 of the user which are placed along side of the break line 7 which is running along the height of the pocket securing portion 6. Folding the mask inward will allow the scented portion 5 to be broken or crushed releasing the scent or the fragrance within. The mask 1 can then be placed over the face 18 of the user for the purpose of blocking out unpleasant odors.

While the specification illustrates a number of different embodiments for applying a scented portion medium to the mask, it is understood that there are numerous other possible embodiments for the scented portions according to the present invention. Additional embodiments will become apparent to those skilled in the art to which it pertains upon review of the appended claims.

The invention claimed is:

1. A mask placeable over at least one respiratory organ of a user's face for blocking out unpleasant odors and for emitting a scent which is pleasant to the user, said mask comprising:

an air-permeable body having an inner surface, said inner surface having a profile which is shaped to fit over a respiratory organ of the user;

a strap extending from opposite sides of said mask for securing said mask over the respiratory organ of the user; and an air-permeable scenting device attached to said body for enabling said body to emit any of a plurality of different scents which are pleasant to the user, said device including a substantially unitary permanently sealed tubular body disposed within a pocket formed by a securing member, said securing member being attached to said inner surface of said air-permeable body to form said pocket for substantially enclosing said tubular body, said tubular body being breakable by means of a bending moment applied by the user between generally inner and outermost ends of said tubular body to release said scent within said tubular body, said device further including a membrane substantially enclosing said tubular body, said membrane being substantially saturable by said scent when said tubular body is broken to release said scent through said air-permeable body.

2. The mask as described in claim 1, wherein said tubular body is made of one of glass and plastic.

3. The mask as described in claim 1, wherein said membrane is made of a cloth like material.

4. A mask placeable over at least one respiratory organ of a user's face for blocking out unpleasant odors and for emitting a scent which is pleasant to the user, said mask comprising:

an air-permeable body having an inner surface, said inner surface having a profile which is shaped to fit over a respiratory organ of the user; and an air-permeable scenting device attached to said body for enabling said body to emit any of a plurality of different scents which are pleasant to the user, said device including a substantially unitary permanently sealed elongated body disposed within a pocket formed by a securing member, said securing member being attached to said inner surface of said air-permeable body to form said pocket for substantially enclosing said elongated body, said elongated body being breakable by means of a bending moment applied by the user between generally inner and outermost ends of said elongated body to release said scent within said elongated body.

5. The mask as described in claim 4, wherein said elongated body is made of one of glass and plastic.

6. The mask as described in claim 4, said device further including a membrane substantially enclosing said elongated body, said membrane being substantially saturable by said scent when said elongated body is broken to release said scent through said air-permeable body.

7. The mask as described in claim 6, wherein said membrane is made of a cloth like material.

8. The mask as described in claim 4, further comprising a strap extending from opposite sides of said mask for securing said mask over the respiratory organ of the user.

9. A method of using a mask placeable over at least one respiratory organ of a user's face for blocking out unpleasant odors and for emitting a scent which is pleasant to the user, said method comprising:

providing an air-permeable body having an inner surface, said inner surface having a profile which is shaped to fit over a respiratory organ of the user;

attaching an air-permeable scenting device to said body for enabling said body to emit any of a plurality of different scents which are pleasant to the user, said device including a substantially unitary permanently sealed elongated body disposed within a pocket formed by a securing member;

attaching said securing member to said inner surface of said air-permeable body to form said pocket for substantially enclosing said elongated body;

breaking said elongated body by means of a bending moment applied by the user between generally inner and outermost ends of said elongated body to release said scent within said elongated body; and securing said mask over the respiratory organ of the user.

10. The method as described in claim 9, wherein said elongated body is made of one of glass and plastic.

11. The method as described in claim 9, enclosing said elongated body by a membrane, said membrane being substantially saturable by said scent when said elongated body is broken to release said scent through said air-permeable body.

12. The method as described in claim 11, wherein said membrane is made of a cloth like material.

13. The method as described in claim 9, wherein said securing including securing said mask over the respiratory organ of the user by a strap extending from opposite sides of said mask.

* * * * *